United States Patent [19]

Nielsen

[11] 4,372,057

[45] Feb. 8, 1983

[54] INSOLE

[76] Inventor: Olympia Nielsen, 333 E. 66th St., New York, N.Y. 10021

[21] Appl. No.: 167,243

[22] Filed: Jul. 10, 1980

[51] Int. Cl.[3] ..... A43B 3/10; A43B 13/38

[52] U.S. Cl. ..... 36/10; 36/43

[58] Field of Search ..... 36/9 R, 10, 43, 44, 36/28

[56] References Cited

U.S. PATENT DOCUMENTS

| | | | |
|---|---|---|---|
| 2,798,311 | 7/1957 | Scholl | 36/10 |
| 3,243,901 | 4/1966 | Clarizio | 36/10 |
| 3,299,540 | 1/1967 | Scholl | 36/10 |
| 4,229,889 | 10/1980 | Petrosky | 36/43 |

*Primary Examiner*—Patrick D. Lawson

*Attorney, Agent, or Firm*—Alexander C. Wilkie, Jr.

[57] ABSTRACT

An insole of moisture absorbent material is shaped to conform to an average persons's foot sole so that it covers all or at least the forward portion of the wearer's foot. This insole is removably inserted in the wearer's sock to absorb moisture thereby protecting the wearer against the problems which stem from excess foot moisture and wet socks. The improved result is a washable and easily applied means for moisture protection of the wearer's feet consisting of a regular sock and a moisture absorbing insole positioned within the sock.

1 Claim, 4 Drawing Figures

INSOLE

BACKGROUND OF THE INVENTION

This invention relates to a moisture absorbent protective means for feet and more particularly to a removable and washable moisture absorbent insole to be worn inside the wearer's regular socks.

An increased danger of infection as well as foot discomfort results from the accumulation of perspiration in socks and in other foot coverings particularly in the case of a bed ridden patient or ambulatory patients. Although certain moisture absorbing means have been proposed including socks themselves, these means have not experienced wide usage due to their expense and general unavailability when needed.

The present invention provides an inexpensive and shaped moisture absorbent insole formed of a foam rubber or plastic or similar moisture absorbing material. A particular advantage of the insole is that it may be formed of a washable material and may be readily removed, cleaned, and dried for reuse. In the case where certain other inexpensive materials are used, it is disposable.

Accordingly, an object of the present invention is to provide improved moisture absorbing footwear.

Another object of the present invention is to provide an inexpensive and easily used moisture absorbent sock arrangement.

Another object of the present invention is to provide a moisture absorbent insole which is easily removed, washed, and cleaned for reuse.

Other and further objects of the present invention will become apparent upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein.

DESCRIPTION OF THE PREFERRED EMBODIMENT

Figure 1:
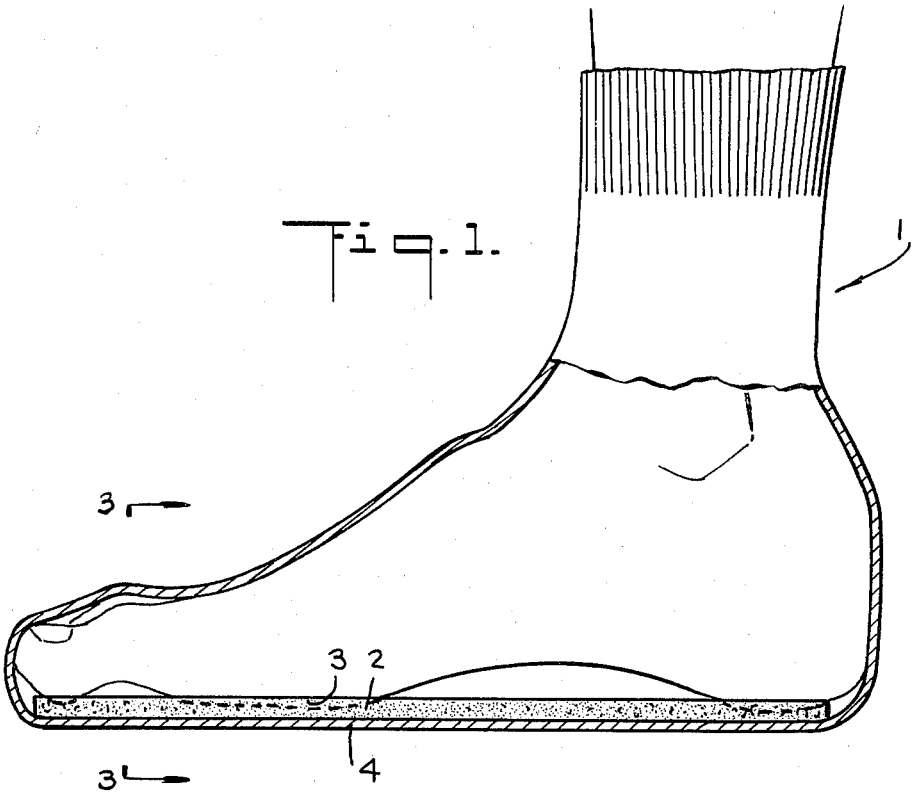
FIG. 1 is a side elevational view of the insole and sock combination in accordance with the present invention.

As illustrated in the drawings, a preferred combination in accordance with the invention comprises a regular sock 1, worn in the usual manner with an insole 2 of the invention positioned between the wearer's soles 3 and the normal sock bottom 4. The insole 2 is placed in this position either by inserting it within the sock 1 in the desired position or by placing it on the wearer's sole as a sock 1 is pulled into place.

The insole 2 is formed of a moisture absorbent material. A preferred material is a foamed or cellular material such as foam plastic or rubber. These materials are particularly desirable as they are both moisture absorbent and also may be removed and washed for reuse. Other cellular or absorbent materials may be used including paper or paper-like material where the insole 2 is moisture absorbent and where the minimal expense makes their disposal after use practical.

Figure 2:
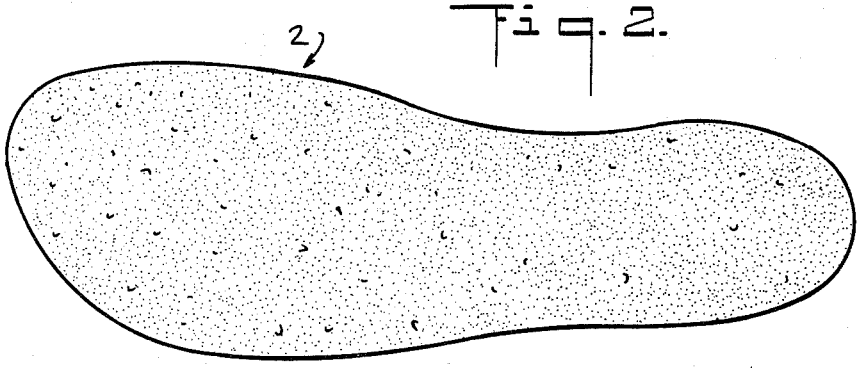
FIG. 2 is a top plan view of an insole in accordance with the present invention.
Figure 3:
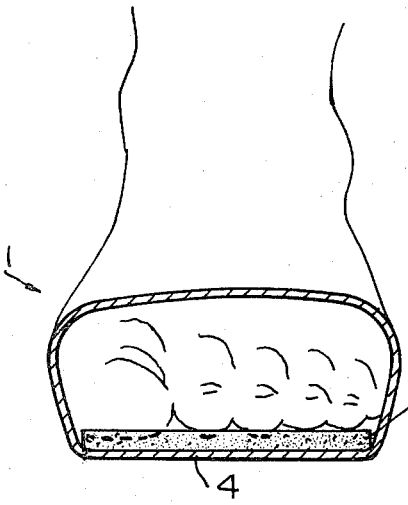
FIG. 3 is a vertical sectional view taken along line 3—3 on FIG. 1.

FIG. 2 is a plan view of a typical insole 2 having a shape which is seen to conform generally to the wearer's sole shape. While a typical normal adult shape will serve for almost all use, the insoles 2 may be furnished in differing sizes such as small, medium and large. The soft nature of the insole 2 material and its low cost also mean that a user may cut the insoles to the particular shape which the wearer finds most comfortable.

Figure 4:
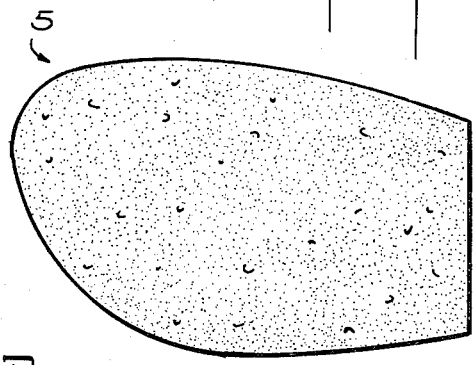
FIG. 4 is a top plan view of a partial sole of the present invention.

FIG. 4 illustrates another embodiment of an insole 5, where less than the full insole shape is used. Since a significant portion of the moisture accumulates on the broad forward portion of the foot, useful insoles may be furnished which have a shape corresponding only to this portion of the wearer's sole.

As absorbent materials and particularly cellular or foamed materials have the capability of absorbing significant amounts of moisture, the insoles 2 or 5 may be worn for extended periods of time and they will provide protection as described above during these extended periods.

It will thus be seen that the novel insoles of the present invention provide for a significant improvement in comfort and protection for persons wearing socks and particularly certain persons where the protection provided by the socks must be accommodated by a relatively dry foot condition. This result is obtained by the above described combination in a convenient and relatively inexpensive manner and also in a manner which requires only a moderate investment in the protective insoles.

As various changes may be made in the form, construction and arrangement of the invention and without departing from the spirit and scope of the invention, and without sacrificing any of its advantages, it is to be understood that all matter herein is to be interpreted as illustrative and not in a limiting sense.

Having thus described my invention, I claim:

1. An improved moisture absorbing foot covering comprising the combination of:

a woven foot sock having integral sole and upper portions;

a moisture absorbing resilient insole of cellular material positioned within said sock and substantially covering the inner surface of the sole of said sock; and said insole being shaped to generally conform to the shape of the sole of a human foot.

* * * * *